US005500567A

United States Patent [19]

Wilson et al.

[11] Patent Number: 5,500,567

[45] Date of Patent: Mar. 19, 1996

[54] APPARATUS FOR SECURING AN AMALGAM AT THE APEX OF AN ELECTRODELESS FLUORESCENT LAMP

[75] Inventors: Ronald H. Wilson, Schenectady; Douglas A. Doughty, West Charlton; John P. Cocoma, Clifton Park, all of N.Y.

[73] Assignee: General Electric Company, Schenectady, N.Y.

[21] Appl. No.: 194,549

[22] Filed: Feb. 10, 1994

[51] Int. Cl.[6] ..... H01J 61/28; H05B 41/00

[52] U.S. Cl. ..... 313/490; 313/550; 313/552; 313/565; 315/248; 315/267; 315/344

[58] Field of Search ..... 313/490, 564, 313/565, 550, 552; 315/248, 344, 267

[56] References Cited

U.S. PATENT DOCUMENTS

| | | | |
|---|---|---|---|
| 2,325,110 | 7/1943 | Colborne | 313/550 |
| 2,532,463 | 12/1950 | Samer | 313/565 |
| 2,939,985 | 6/1960 | Kolkman | 313/490 |
| 3,634,717 | 1/1972 | LaGarenne et al. | 313/490 |
| 4,010,400 | 3/1977 | Hollister . | |
| 4,262,231 | 4/1981 | Anderson et al. . | |
| 4,437,041 | 3/1984 | Roberts . | |
| 4,539,508 | 9/1985 | Mulder et al. | 313/490 |
| 4,622,495 | 11/1986 | Smeelen . | |
| 4,642,512 | 2/1987 | Matsuno et al. | 313/490 |
| 4,728,867 | 3/1988 | Postma et al. | 315/248 |
| 5,256,935 | 10/1993 | Dobashi et al. | 313/490 |

FOREIGN PATENT DOCUMENTS

| | | | |
|---|---|---|---|
| 52-16965 | 2/1977 | Japan | 313/550 |
| 1034024 | 6/1966 | United Kingdom | 313/550 |

*Primary Examiner*—Sandra L. O'Shea
*Assistant Examiner*—Matthew J. Esserman
*Attorney, Agent, or Firm*—Jill M. Breedlove; Marvin Snyder

[57] ABSTRACT

A glass rod extending through and sealed to the exhaust tube of an electrodeless SEF fluorescent discharge lamp has a metal support member at one end thereof for supporting an amalgam at or near the apex of the lamp envelope. The metal support member may comprise a spiral-shaped wire, a wire screen, or a wire basket. Preferably, the amalgam is maintained in contact with the apex of the lamp envelope. If desired, the metal support member may comprise a magnetic material to allow for magnetic transport of the amalgam assembly during lamp processing. The metal support member restricts spreading of the amalgam when in a liquid state; and the glass rod provides rigid support for the amalgam independent of lamp orientation.

8 Claims, 3 Drawing Sheets

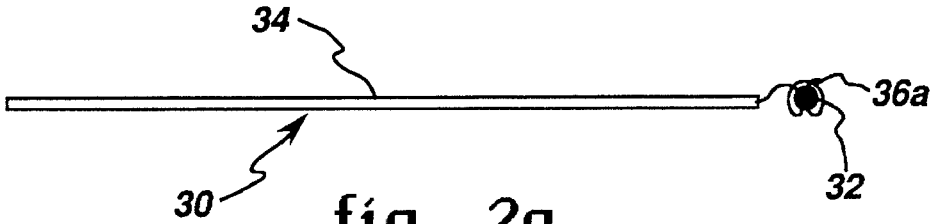
fig. 2a
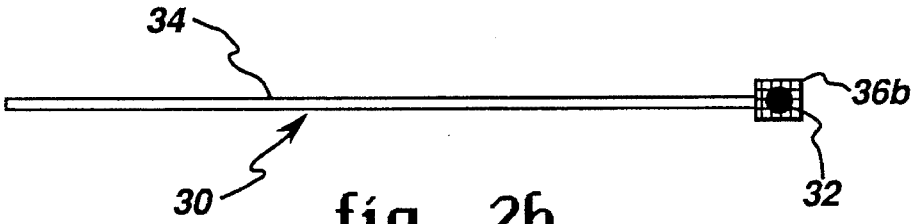
fig. 2b
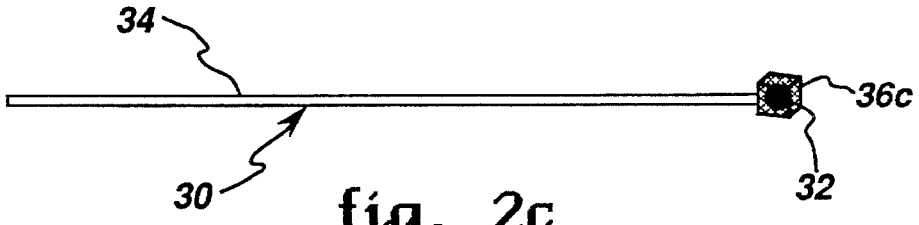
fig. 2c
fig. 4
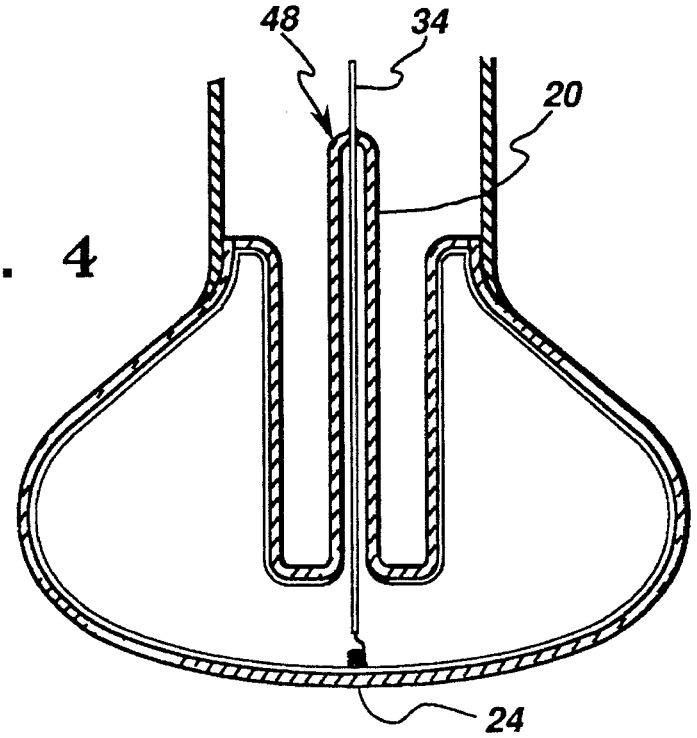

APPARATUS FOR SECURING AN AMALGAM AT THE APEX OF AN ELECTRODELESS FLUORESCENT LAMP

FIELD OF THE INVENTION

The present invention relates generally to electrodeless fluorescent lamps and, more particularly, to placement and support of an amalgam in such a lamp for optimally controlling mercury vapor pressure therein.

BACKGROUND OF THE INVENTION

The optimum mercury vapor pressure for production of 2537 Å radiation to excite a phosphor coating in a fluorescent lamp is approximately six millitorr, corresponding to a mercury reservoir temperature of approximately 40° C. Conventional tubular fluorescent lamps operate at a power density (typically measured as power input per phosphor area) and in a fixture configuration to ensure operation of the lamp at or about a mercury vapor pressure of six millitorr (typically in a range from approximately four to seven millitorr); that is, the lamp and fixture are designed such that the coolest location, i.e., cold spot, in the fluorescent lamp is approximately 40° C. Compact fluorescent lamps, however, including electrodeless solenoidal electric field (SEF) fluorescent discharge lamps, operate at higher power densities with the cold spot temperature typically exceeding 50° C. As a result, the mercury vapor pressure is higher than the optimum four to seven millitorr range, and the luminous output of the lamp is decreased.

One approach to controlling the mercury vapor pressure in an SEF lamp is to use an alloy capable of absorbing mercury from its gaseous phase in varying amounts, depending upon temperature. Alloys capable of forming amalgams with mercury have been found to be particularly useful. The mercury vapor pressure of such an amalgam at a given temperature is lower than the mercury vapor pressure of pure liquid mercury.

Unfortunately, positioning an amalgam to achieve a mercury vapor pressure in the optimum range in an SEF lamp is difficult. For stable long-term operation, the amalgam should be placed and retained in a relatively cool location with minimal temperature variation. Such an optimal location is at or near the tip, or apex, of the lamp envelope.

Accordingly, it is desirable to provide a relatively simple method and apparatus for introducing and securing an amalgam at or near the apex of the envelope of an electrodeless SEF fluorescent discharge lamp. A practical amalgam support should maintain the optimal location of the amalgam, regardless of lamp orientation.

SUMMARY OF THE INVENTION

A glass rod extending through and sealed to the exhaust tube of an electrodeless SEF fluorescent discharge lamp has a metal support member at one end thereof for supporting an amalgam at or near the apex of the lamp envelope. The metal support member may comprise a spiral-shaped wire, a wire screen, or a wire basket. Preferably, the amalgam is maintained in contact with the apex of the lamp envelope. If desired, the metal support member may comprise a magnetic material to allow for magnetic transport of the amalgam assembly during lamp processing.

Advantageously, the metal support member restricts ,spreading of the amalgam when in a liquid state. Furthermore, the glass rod provides rigid support for the amalgam independent of lamp orientation.

BRIEF DESCRIPTION OF THE DRAWINGS

The features and advantages of the present invention will become apparent from the following detailed description of the invention when read with the accompanying drawings in which:

FIGS. 2*a–c* illustrate alternative embodiments of an amalgam support for securing an amalgam in an electrodeless SEF fluorescent lamp in accordance with the present invention;

FIG. 4 illustrates an an electrodeless SEF lamp including an amalgam positioned therein in accordance with the present invention.

DETAILED DESCRIPTION OF THE INVENTION

Figure 1:
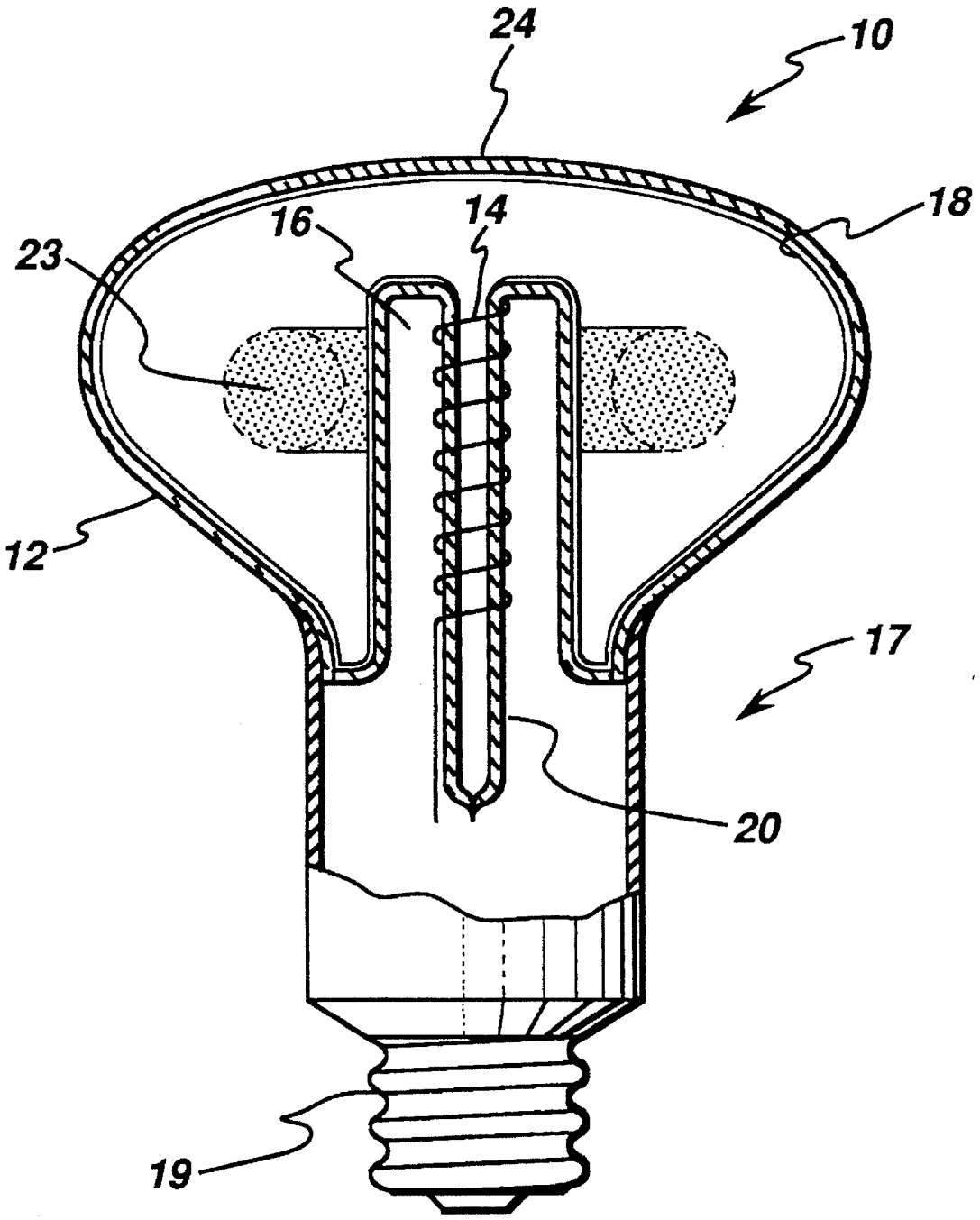
fig. 1 (PRIOR ART)
FIG. 1 illustrates, in partial cross section, a typical electrodeless SEF fluorescent lamp.

FIG. 1 illustrates a typical electrodeless SEF fluorescent discharge lamp 10 having an envelope 12 containing an ionizable gaseous fill. A suitable fill, for example, comprises a mixture of a rare gas (e.g., krypton and/or argon) and mercury vapor and/or cadmium vapor. An excitation coil 14 is situated within, and removable from, a re-entrant cavity 16 within envelope 12. For purposes of illustration, coil 14 is shown schematically as being wound about an exhaust tube 20 which is used for filling the lamp. However, the coil may be spaced apart from the exhaust tube and wound about a core of insulating material or may be free standing, as desired. The interior surfaces of envelope 12 are coated in well-known manner with a suitable phosphor 18. Envelope 12 fits into one end of a base assembly 17 containing a radio frequency power supply (not shown) with a standard (e.g., Edison type) lamp base 19 at the other end.

In operation, current flows in coil 14 as a result of excitation by a radio frequency power supply (not shown). As a result, a radio frequency magnetic field is established within envelope 12, in turn creating an electric field which ionizes and excites the gaseous fill contained therein, resulting in an ultraviolet-producing discharge 23. Phosphor 18 absorbs the ultraviolet radiation and emits visible radiation as a consequence thereof.

In accordance with the present invention, a properly constituted amalgam is accurately placed and retained in an optimal location in an SEF lamp for operation at a mercury vapor pressure in the optimum range from approximately four to seven millitorr, which amalgam maintains its composition and location during lamp operation, regardless of lamp orientation. In particular, the amalgam is accurately positioned and retained at a relatively cool location with minimal temperature variation substantially at the apex 24 of the lamp envelope. The apex of the lamp envelope typically comprises the cold spot of the lamp.

An exemplary amalgam comprises a combination of bismuth and indium. Another exemplary amalgam comprises pure indium. Still another exemplary amalgam comprises a combination of lead, bismuth and tin, such as described in commonly assigned U.S. Pat. No. 4,262,231, cited hereinabove. Yet another amalgam may comprise zinc. And yet another amalgam may comprise a combination of zinc, indium and tin. Each amalgam has its own optimum range of operating temperatures.

FIG. 2*a* illustrates an amalgam support 30 for maintaining an amalgam 32 in an optimal position at or near the apex of the envelope of an electrodeless SEF lamp in accordance with one embodiment of the present invention. Amalgam support 30 includes a glass rod 34 with a metal support member 36*a* at one end thereof. As shown in. FIG. 2*a*, metal support member 36*a* may comprise a spiral-shaped wire. However, other configurations of the metal support member may be desirable, such as, for example, a wire screen 36*b* (FIG. 2*b*) or a wire basket 36*c* (FIG. 2*c*).

Amalgam 32 is wetted to metal support member 36*a* according to a suitable method, such as that described in Anderson et al. U.S. Pat. No. 4,262,231, issued Apr. 14, 1981 and incorporated by reference herein. Suitable metal support members comprise, for example, nickel or steel.

Figure 3:
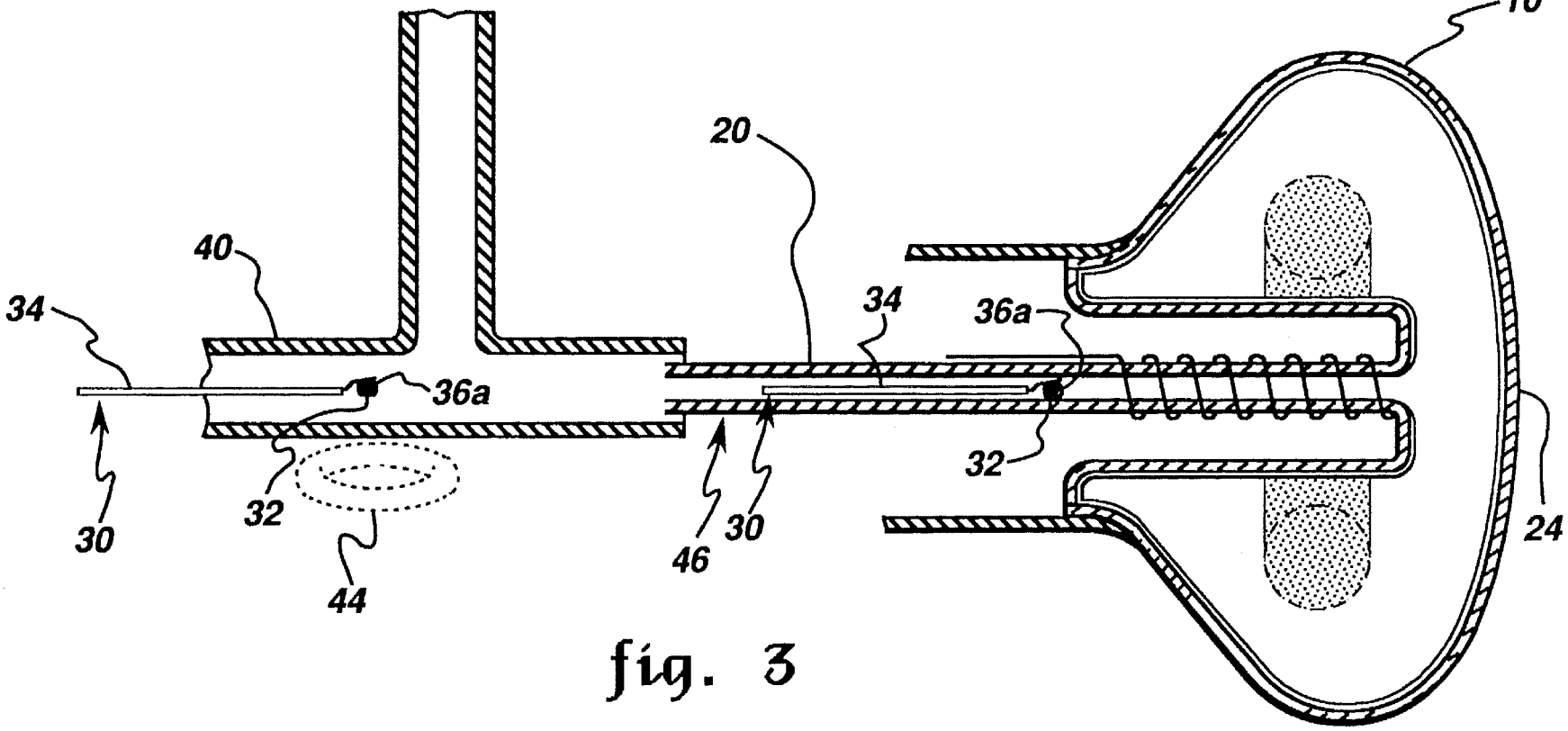
FIG. 3 illustrates a process for introducing and securing an amalgam in an electrodeless SEF lamp in accordance with the present invention.

FIG. 3 illustrates the process sequence for introducing and securing amalgam 32 in an electrodeless SEF lamp in accordance with the present invention. After the lamp has been evacuated and filled in well-known manner via a pumping line 40 and exhaust tube 20, amalgam support 30 is inserted into pumping line 40. The amalgam support is then transported into exhaust tube 20. This transporting step may be accomplished in a number of ways. For example, a mechanical plunger could be applied to the end of the glass rod. Alternatively, a magnetic carrier (shown as a toroidal magnet 44 in phantom for purposes of illustration) could be used to transport a magnetic amalgam support from the pumping line to the exhaust tube. With amalgam support 30 in exhaust tube 20, the exhaust tube is sealed at a first tip-off region 46. The lamp is then cooled. At an appropriate temperature, the lamp is tilted so that amalgam 32 falls into contact with the lamp envelope at the apex 24, as shown in FIG. 4. The exhaust tube is then sealed again at a second tip-off region 48 such that glass rod 34 is sealed to exhaust tube 20 with amalgam support 30 held rigidly in place.

In a preferred embodiment, metal support member 36*a* holds amalgam 32 in contact with lamp envelope 12. Advantageously, metal support member 36*a* restricts the spread of the amalgam when in a liquid state. In addition, metal support member 36*a* accommodates any-strain between the glass rod and the envelope. As yet an additional advantage, amalgam support 30 holds the amalgam in position regardless of lamp orientation. Furthermore, the glass rod could be used to introduce and support an additional start-up amalgam (not shown) for supplying mercury during the period when the lamp is warming up.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A solenoidal electric field (SEF) fluorescent discharge lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation, said envelope having an apex portion, said envelope further having a re-entrant cavity formed therein;

an excitation coil contained within said re-entrant cavity for providing said radio frequency magnetic field when excited by a radio frequency power supply;

an exhaust tube extending through said re-entrant cavity;

an amalgam support for supporting an amalgam within said envelope, said amalgam support comprising a rod extending through said exhaust tube and being sealed thereto, said rod having a metal support member at one end thereof for holding said amalgam and positioning said amalgam substantially at said apex portion of said envelope.

2. The lamp of claim 1 wherein said amalgam is maintained in contact with said apex portion of said envelope during lamp operation.

3. The lamp of claim 1 wherein said metal support member comprises a spiral-shaped wire.

4. The lamp-of claim 1 wherein said metal support member comprises a wire screen.

5. The lamp of claim 1 wherein said metal support member comprises a wire basket.

6. The lamp of claim 1 wherein said metal support member comprises nickel.

7. The lamp of claim 1 wherein said metal support member comprises steel.

8. The lamp of claim 1 wherein said rod comprises glass.

* * * * *